US011165141B2

(12) United States Patent
Hsu et al.

(10) Patent No.: US 11,165,141 B2
(45) Date of Patent: Nov. 2, 2021

(54) ANTENNA ASSEMBLIES FOR WATCH BANDS

(71) Applicant: Apple Inc., Cupertino, CA (US)

(72) Inventors: Jen-Chun Hsu, Taipei (TW); Yi-Chia Chen, Taipei (TW); Osamu Yabe, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 449 days.

(21) Appl. No.: 15/968,620

(22) Filed: May 1, 2018

(65) Prior Publication Data

US 2019/0341677 A1 Nov. 7, 2019

(51) Int. Cl.

| | |
|---|---|
| ***G04G 17/06*** | (2006.01) |
| ***H01Q 1/27*** | (2006.01) |
| ***A44C 5/00*** | (2006.01) |

(52) U.S. Cl.

CPC ..... *H01Q 1/273* (2013.01); *A44C 5/0069* (2013.01); *G04G 17/06* (2013.01)

(58) Field of Classification Search

CPC ..... G04B 37/1486; A44C 5/08; A44C 5/14; A44C 5/105; A44C 5/0069; A45F 5/00; A45F 2005/008; A44D 2203/00; G04G 17/06

See application file for complete search history.

(56) References Cited

U.S. PATENT DOCUMENTS

| | | | | |
|---|---|---|---|---|
| 2003/0103414 | A1 | 6/2003 | Lyon | |
| 2014/0266939 | A1 | 9/2014 | Baringer et al. | |
| 2015/0220109 | A1* | 8/2015 | von Badinski | H02J 7/35 340/539.12 |
| 2015/0364938 | A1* | 12/2015 | Lapetina | H01F 27/36 320/114 |
| 2016/0037878 | A1* | 2/2016 | Yabe | G04B 37/1486 24/3.1 |
| 2016/0062319 | A1* | 3/2016 | Kim | H02J 7/025 368/204 |
| 2016/0062392 | A1 | 3/2016 | Townsend et al. | |

(Continued)

FOREIGN PATENT DOCUMENTS

| | | |
|---|---|---|
| CN | 1592986 A | 3/2005 |
| CN | 104766105 | 7/2015 |
| CN | 105356033 | 2/2016 |

(Continued)

OTHER PUBLICATIONS

Chinese Office Action from Chinese Patent Application No. 201910335526.8, dated Sep. 24, 2020, 16 pages including English language summary.

(Continued)

*Primary Examiner* — Sean Kayes

(74) *Attorney, Agent, or Firm* — Morgan, Lewis & Bockius LLP

(57) ABSTRACT

A watch band for a watch can include an antenna that is operable for wireless communication with other devices. The antenna can be embedded within a body of the watch band to protect the antenna from an external environment and to conceal it from view. The antennas can adaptably stretch, bend, and flex with the watch band body, thereby avoiding damage from applied forces while also maintaining the compliance and comfort of the watch band while worn by a user.

18 Claims, 6 Drawing Sheets

(56) References Cited

U.S. PATENT DOCUMENTS

2018/0210491 A1* 7/2018 Song ..... G04G 17/06

FOREIGN PATENT DOCUMENTS

| | | | |
|---|---|---|---|
| CN | 105372984 | A | 3/2016 |
| CN | 205122753 | U | 3/2016 |
| CN | 106104408 | A | 11/2016 |
| CN | 205963145 | U | 2/2017 |
| GB | 2494922 | | 3/2013 |
| WO | WO 2017/023058 | | 2/2017 |

OTHER PUBLICATIONS

Indian Office Action from Indian Patent Application No. 201914016842, dated Jan. 18, 2021, 8 pages.

Chinese Office Action from Chinese Patent Application No. 201910335526.8, dated Apr. 19, 2021, 19 pages including English language summary.

* cited by examiner

ANTENNA ASSEMBLIES FOR WATCH BANDS

FIELD

The present description relates generally to antenna assemblies for watch bands, and, more particularly, to stretchable antenna elements embedded into watch bands.

BACKGROUND

Portable electronic devices have become increasingly popular, and the features and functionality provided by portable electronic devices continue to expand to meet the needs and expectations of many consumers. However, some traditional portable electronic devices, particularly wearable electronic devices, have relatively limited functionality or are only able to perform a specialized set of functions or tasks.

It can be desirable to provide a wearable electronic devices, such as a watch, with wireless communication capabilities. The embodiments described herein are directed to a wearable device that provides wireless communication via an antenna within a band of a watch.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
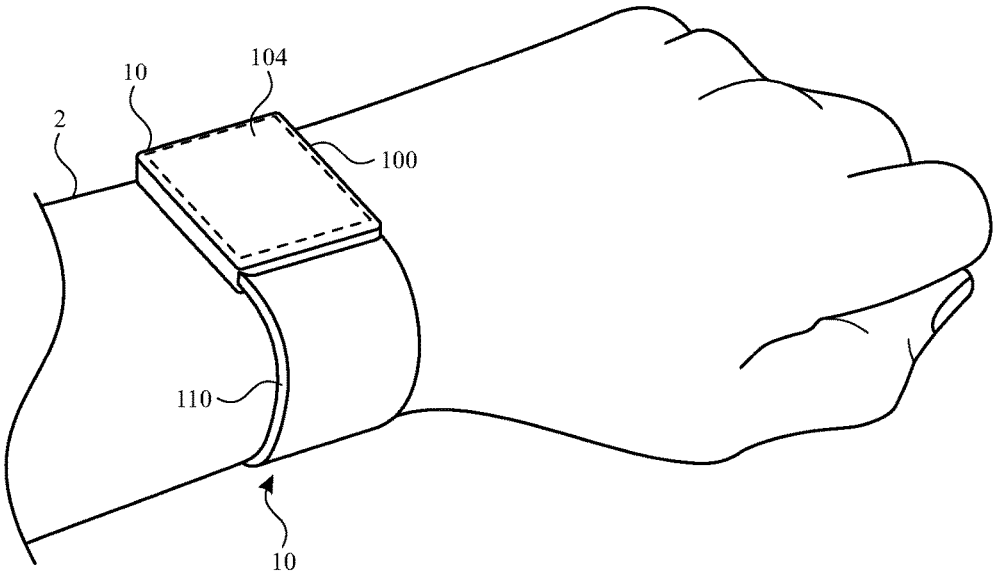
FIG. 1 illustrates a perspective view of a watch on a wrist of a user, according to some embodiments of the present.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The following disclosure relates generally to antenna assemblies for watch bands, and, more particularly, to stretchable antenna elements embedded into watch bands. The watch band provides wireless communication via an antenna embedded within the watch band in a manner that protects the structural integrity and operation of the antenna.

A wearable device, such as a watch, can include a watch body and a watch band for securing the watch to the user. In many traditional watches, neither the watch body nor any other device interacts with the watch band. Instead, the watch body operates independently or does not interact with the watch band while communicating with any other external device. The operating components of the watch body can be protected within a rigid housing. However, it can be desirable to provide certain components outside the rigid housing to more effectively utilize the space within the housing. It can also be desirable to position certain components at locations that are more accessible or that can be more effectively utilized when positioned outside the housing.

In contrast to traditional watches, watch bands described herein can be provided with electronic components that can be operated for wireless communication with other devices. For example, an antenna and appropriate control circuitry can be provided in a watch band, rather than in a watch body, to communicate with other devices. The antenna can be embedded within a body of the watch band to protect the antenna from an external environment. The embedded antenna can be concealed to enhance the aesthetic appearance of the watch band.

Because watch bands stretch, bend, and flex to conform to a wrist of a user, any components contained therein are subjected to forces that can potentially damage such components. Attempts to reinforce these components with durable housings can reduce the ability of the watch band to be compliant and comfortably conform to the wrist of the user.

The watch bands described herein provide antenna assemblies that adaptably stretch, bend, and flex with the bodies of the watch bands. With the features described herein, the embedded antenna assemblies avoid damage from applied forces while also maintaining the compliance and comfort of the watch band while worn by a user.

These and other embodiments are discussed below with reference to FIGS. 1-14. However, those skilled in the art will readily appreciate that the detailed description given herein with respect to these figures is for explanatory purposes only and should not be construed as limiting.

According to some embodiments, for example as shown in FIG. 1, a watch 10 includes a watch body 100 that is worn on a wrist 2 with a watch band 110. The watch body 100 can be portable and also attached to other body parts of the user or to other devices, structures, or objects. The watch band 110 can be flexible and encircle at least a portion of the wrist 2 of a user. By securing the watch body 100 to the person of the user, the watch band 110 provides security and convenience. In some embodiments, the watch body 100 includes a display 104 and a housing for containing components.

Figure 2:
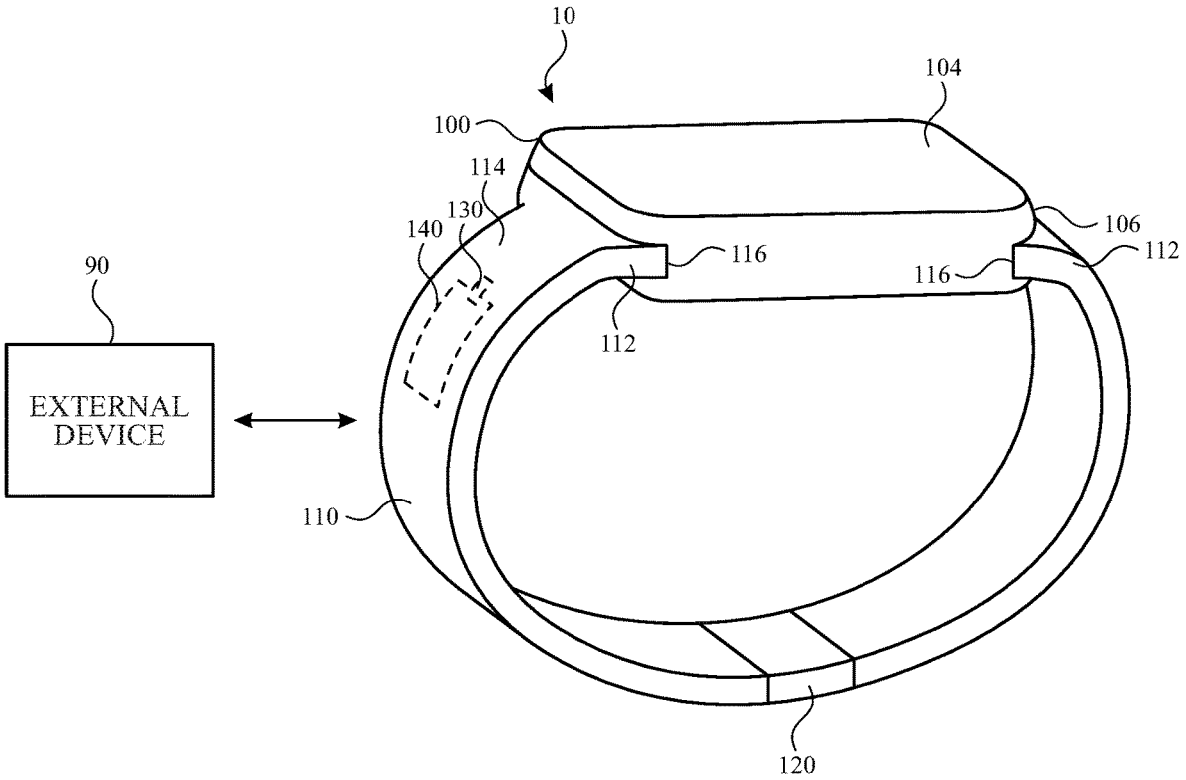
FIG. 2 illustrates a perspective view of a watch, according to some embodiments of the present description.

FIG. 2 illustrates a perspective view of the watch 10, including the watch body 100 and a watch band 110. As shown, the watch body 100 includes a housing 106 that supports the display 104. The watch body 100 can be worn on a user's wrist and secured thereto by the watch band 110. The watch band 110 can be a continuous structure or assembled as separate portions (e.g., straps) that join together and provide adjustable size configurations. For example, a clasp 120 or another mechanism (e.g., buckles, buttons, latches, locks, snaps, threads, and/or pins) can be provided to adjustably connect separate portions of the watch band 110. The watch band 110 includes lugs 112 at opposing ends of the band that fit within respective recesses or channels 116 of the housing 106 and allow the watch band 110 to be removably attached to the housing 106. The lugs 112 may be part of the watch band 110 or may be separable (and/or separate) from the watch band 110. Generally, the lugs 112 may lock into the channels 116 and thereby maintain connection between the watch band 110 and the housing 106. The user may release a locking mechanism (not shown) to permit the lugs 112 to slide or otherwise move out of the channels 116. In some watches, the channels 116 may be formed in the watch band 110 and the lugs may be affixed or incorporated into the housing 106. While lugs 112 and channels 116 are illustrated, it will be recognized that other attachment elements, such as locks, latches, snaps, clasps, threads, and/or pins can be included on the watch band 110 for securely attaching to the watch body 100.

As further shown in FIG. 2, the watch band 110 can include a watch band body 114 that defines a longitudinal length of the watch band 110. The watch band body 114 can be formed from a compliant base material that is configured to easily contour to a user's wrist, while retaining stiffness sufficient to maintain the position and orientation of the wearable device on the user's wrist. It can be desirable that the compliant material of the watch band body 114 provide capabilities of bending, flexing, and stretching to facilitate secure and comfortable fit on a user. Suitable compliant materials may include plastic, rubber, leather, nylon, canvas or other fibrous, organic, polymeric, or synthetic materials.

In some embodiments, the watch band body 114 can be formed from a base material such as a fluoroelastomeric polymer, having a Shore durometer selected for flexibility suitable for easily contouring to a user's wrists and selected for having sufficient stiffness to maintain support of the electronic device when attached to a user's wrist. For example, bands in certain embodiments may have a Shore A durometer ranging from 60 to 80 and/or a tensile strength greater than 12 MPa. In some embodiments, a fluoroelastomeric polymer (or other suitable polymer) can be doped or treated with one or more other materials. For example, the polymer can be doped with an agent configured to provide the polymer with a selected color, odor, taste, hardness, elasticity, stiffness, reflectivity, refractive pattern, texture and so on. The doping agent can confer other properties to the fluoroelastomeric polymer including, but not limited to, electrical conductivity and/or insulating properties, magnetic and/or diamagnetic properties, chemical resistance and/or reactivity properties, infrared and/or ultraviolet light absorption and/or reflectivity properties, visible light absorption and/or reflectivity properties, antimicrobial and/or antiviral properties, oleophobic and/or hydrophobic properties, thermal absorption properties, pest repellant properties, colorfast and/or anti-fade properties, deodorant properties, antistatic properties, medicinal properties, liquid exposure reactivity properties, low and/or high friction properties, hypoallergenic properties, and so on.

As further shown in FIG. 2, the watch band 110 can include an antenna 140 and/or a control unit 130 embedded within the watch band body 114. The watch band body 114 can entirely surround the antenna 140 and/or the control unit 130 such that no portion of the antenna 140 and/or the control unit 130 is exposed to an external environment. The watch band 110 can include multiple antennae 140 and/or control units 130.

The antenna 140 can be positioned such that, while the watch band 110 is worn by a user, the antenna 140 is positioned and oriented in a manner that facilitates communication with another device. For example, the antenna 140 can face outwardly away from the user. The user can facilitate communication with an external device 90 by bringing the antenna 140 into the proximity of the external device 90 and directing the antenna 140 toward the external device 90.

The antenna 140 and/or the control unit 130 can include or provide a radio-frequency identification (RFID) system that is configured to enable one-way or two-way radio-frequency (RF) communications with the external device 90. The one- or two-way communication may include an identification of the watch 10 and/or the external device 90.

The identification can be used to initiate a secured data connection between the two devices. The secured data connection may be used to authorize a transaction between the user and an entity that is associated with the external device 90.

In some embodiments, the user may initiate a communication with the external device 90 by placing the watch 10 near an active region on the external device 90. In some implementations, the external device 90 is configured to automatically detect the presence of the watch 10 and initiate an identification process or routine. The RFID system of the watch 10 can include a unique identifier or signature that may be used to authenticate the identity of the user. As previously mentioned, the identification process or routine may be used to establish a secure data connection between the watch 10 and the external device 90. The secure data connection may be used to authorize a purchase or download of data to or from the watch 10. In some cases, the secure data connection may be used to authorize the transfer of funds from a credit card or financial institution in exchange for a product that is associated with the external device 90. Other transactions or forms of electronic commerce may also be performed using the wireless communication between the watch 10 and the external device 90.

The antenna 140 can be used for other types of communication. For example, the antenna 140 can operate as a short-range wireless antenna (e.g., Bluetooth™ antenna), a near-field antenna, a Global Positioning System (GPS) antenna, and/or another antenna for a transceiver.

Figure 3:
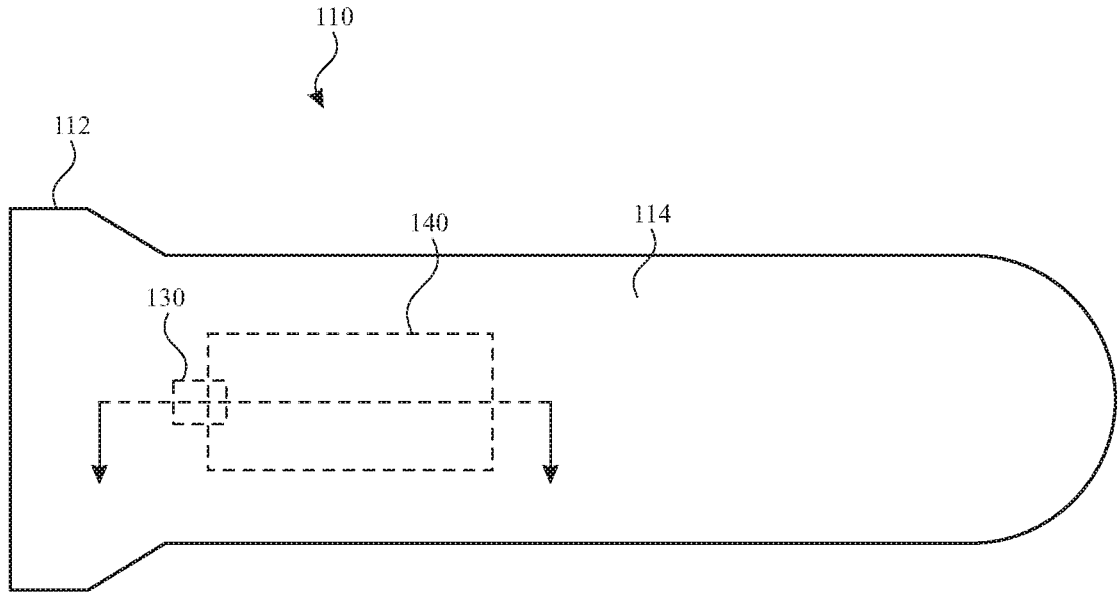
FIG. 3 illustrates a top view of a watch band, according to some embodiments of the present.
Figure 4:
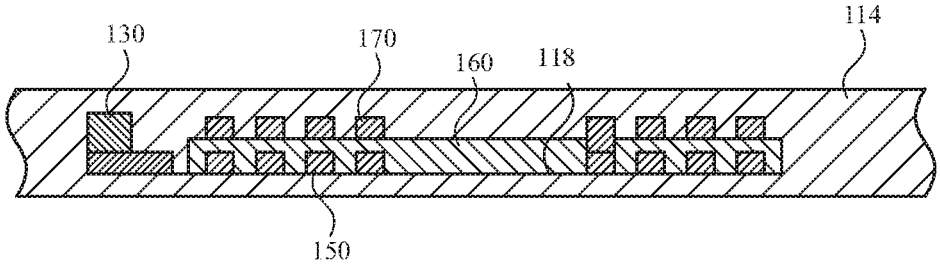
FIG. 4 illustrates a sectional view of the watch band of FIG. 3, according to some embodiments of the present.

FIGS. 3 and 4 illustrate, respectively, a top view and a sectional view of a watch band 110. As shown, the watch band 110 includes a lug 112 for securely attaching to the watch body. The watch band 110 further includes the watch band body 114 extending from the lug 112 along a longitudinal length (e.g., axis) of the watch band 110. As described above, the watch band body 114 surrounds and/or houses the antenna 140 and/or the control unit 130.

As shown in FIGS. 3 and 4, the control unit 130 is operatively connected to the antenna 140. For example, one or more ends of the antenna can be directly connected to the control unit 130. The control unit 130 can be positioned between the antenna 140 and the lug 112 to provide greater protection to the connection between the control unit 130 and the antenna. For example, in regions close to the lug 112, the watch band body 114 may undergo less stretching and flexing than at other regions farther away from the lug 112.

As shown in FIG. 4, the watch band body 114 has embedded therein the antenna 140 and/or the control unit 130. The antenna 140 can include a first antenna layer 150 and a second antenna layer 170. Each of the first antenna layer 150 and the second antenna layer 170 can form a coil that includes multiple windings about a central axis. The coil can be a spiral coil that lies within a plane, as described further herein. The planar configuration can provide a wide area for activity of the antenna without requiring a significant thickness within the watch band body 114.

The antenna 140 can be formed from a material that provides desired mechanical and electrical properties. For example, the antenna 140 can include a mixture of an elastic polymer and conductive particles. The elastic polymer can include one or more of a variety of elastic materials, such as polyethylene terephthalate (pet) and polyimides. The conductive particles can include one or more of a variety of conductive materials, such as silver or carbon. It will be appreciated that a variety of mixtures can be provided to include both an elastic polymer and conductive particles. For example, the conductive particles can be any metal or combination of metals. The conductive particles can include silver, copper, gold, aluminum, zinc, nickel, brass, bronze, iron, platinum, steel, lead, stainless steel, and/or combinations thereof. The elastic polymer can include fluoroelastomers, perfluoroelastomers, polyether block amides, chlorosulfonated polyethylene, ethylene-vinyl acetate, thermoplastic elastomers, polysulfide rubber, elastolefin, polyisoprene, polybutadiene, chloroprene rubber, polychloroprene, neoprene, baypren, butyl rubber, styrene-butadiene rubber, nitrile rubber, ethylene propylene rubber, ethylene propylene diene rubber, epichlorohydrin rubber, polyacrylic rubber, silicone rubber, fluorosilicone rubber, and/or combinations thereof. The conductive particles can be provided in one of a variety of shapes, sizes, and distributions within the elastic polymer. The materials for the antenna 140 can be provided as an ink or paste that is applied to the watch band body 114 and cured, as further described herein.

The elastic polymer of the antenna 140 can provide desired mechanical properties, such as the ability to adaptably stretch, bend, and flex with the watch band body 114. The antenna 140, or at least a portion thereof, can be directly connected to (e.g., fixed to, adhered to, printed onto, cured onto, cross-linked to, and/or integral with) the watch band body 114. For example, the watch band body 114 can surround and/or encapsulate an entirety of the antenna 140 within an interior region of the watch band body 114. The watch band body 114 can provide an inner surface 118 that defines a boundary of the interior region, and the antenna 140 can be provided directly on the inner surface 118 of the watch band body 114. In some examples, no intervening structure is provided between the antenna 140 and the watch band body 114, such that the antenna 140, or a portion thereof, is directly connected to the inner surface 118 of the watch band body 114. Because the antenna 140 may desirably extend across a significant length of the watch band body 114, at least some portion of the antenna 140 moves with the watch band body 114 while worn by a user. For example, the watch band body 114 may be stretched along a longitudinal length of the watch band 110, and the first antenna layer 150 and the second antenna layer 170 can elastically stretch with the watch band body 114 without incurring damage (e.g., breaking, cracking, deformation). Similarly, the watch band body 114 may bend and/or flex about a wrist of the user, and the first antenna layer 150 and the second antenna layer 170 can elastically bend and/or flex with the watch band body 114.

The conductive particles of the antenna 140 can provide desired electrical properties, such as conductivity along an entire length of the antenna 140. The conductive particles can be provided in adequate amounts and/or density to provide the desired conductivity. The conductive particles can provide electrical conductivity while maintaining the stretchability and flexibility of the antenna 140.

As shown in FIG. 4, the first antenna layer 150 and the second antenna layer 170 can be at least partially separated by an insulation layer 160. For example, the insulation layer 160 can be positioned between portions of the first antenna layer 150 and portions of the second antenna layer 170. The first antenna layer 150 and the second antenna layer 170 can be connected to each other through portions of the insulation layer 160. For example, the first antenna layer 150 and the second antenna layer 170 can form a continuous loop from a first terminal of the control unit 130 to a second terminal of the control unit 130. The control unit 130 can be directly connected to the first antenna layer 150 and operatively connected to the second antenna layer 170 via the first antenna layer 150.

It will be appreciated that the antenna 140 can be provided with any number of layers. For example, the antenna 140 can include 1, 2, 3, 4, 5, 6, 7, 8, 9, or more than 9 layers. Any given pair of the layers can at least partially overlap or have no overlap. An insulation layer can be provided between any adjacent pair of layers with connections provided there through as desired.

Methods of assembling the watch band 110 are described herein. Exemplary stages are illustrated in FIGS. 5-13 to produce the watch band described above. It will be appreciated that the described methods can be performed with variations in the order and number of operations illustrated.

Figure 5:
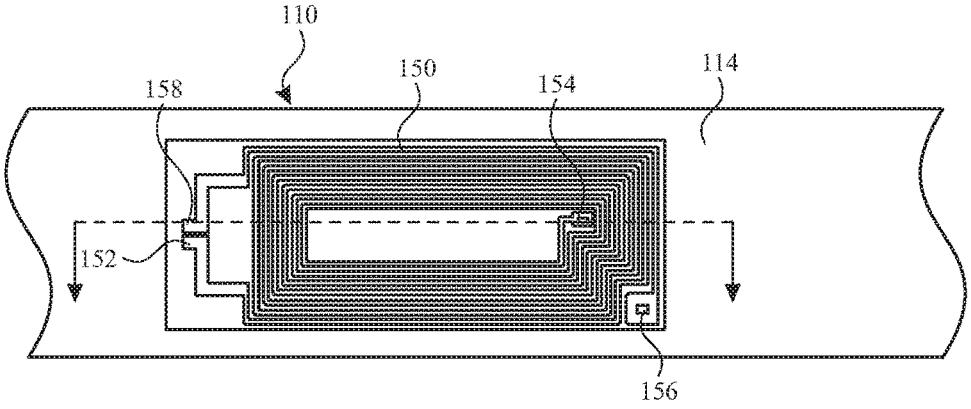
FIG. 5 illustrates a top view of a watch band in a first stage of assembly, according to some embodiments of the present.
Figure 6:
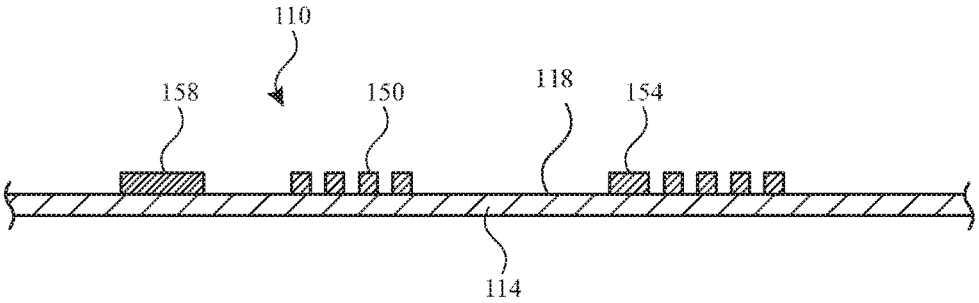
FIG. 6 illustrates a sectional view of the watch band of FIG. 5, according to some embodiments of the present.

FIGS. 5 and 6 illustrate, respectively, a top view and a sectional view of the watch band 110 in a first stage of assembly. As shown in FIGS. 5 and 6, the first antenna layer 150 is formed on the inner surface 118 of the watch band body 114 providing a base material (e.g., substrate). The first antenna layer 150 can be formed by printing on the watch band body 114 with a conductive ink (e.g., paste). The conductive ink can be allowed to cure with a thermosetting process that may include an elevated temperature and/or pressure for a duration of time. The resulting first antenna layer 150 can include multiple lengths that may or may not electrically connect to each other. For example, a second antenna layer may be required to complete a loop. As shown in FIG. 5, a first terminal end 152 and a second terminal end 158 can be provided to connect to a control unit (to be provided in a later stage). Each of the first terminal end 152 and the second terminal end 158 can be electrically connected to, respectively, a first connector end 154 and a second connector end 156. The first connector end 154 and the second connector end 156 can be provided to connect to a second, overlapping antenna layer (to be provided in a later stage).

Figure 7:
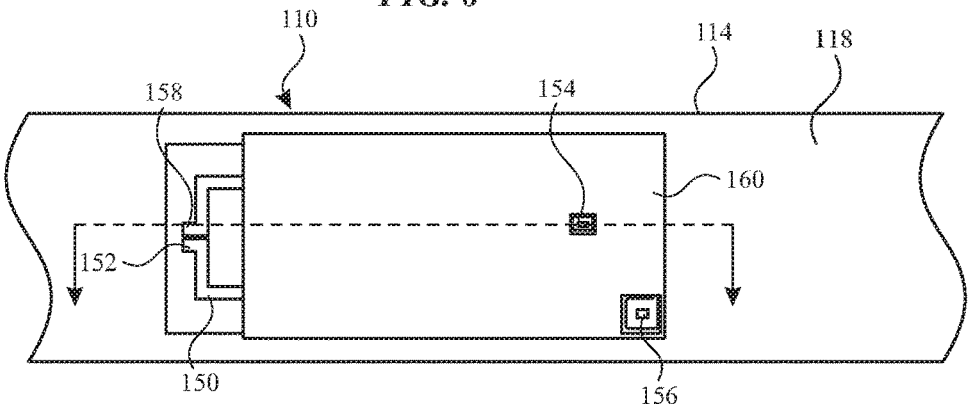
FIG. 7 illustrates a top view of the watch band in a second stage of assembly, according to some embodiments of the present.
Figure 8:
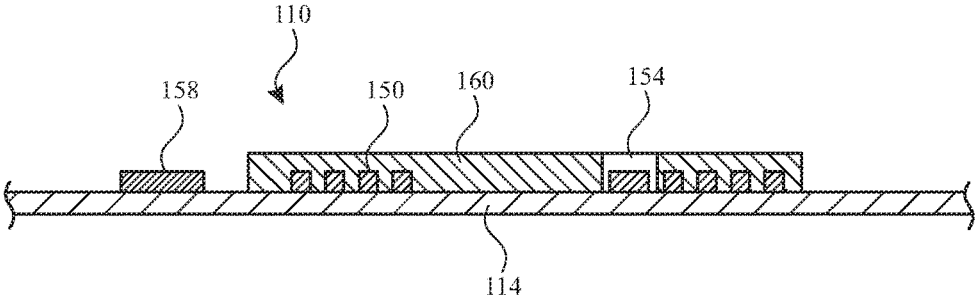
FIG. 8 illustrates a sectional view of the watch band of FIG. 7, according to some embodiments of the present.

FIGS. 7 and 8 illustrate, respectively, a top view and a sectional view of the watch band 110 in a second stage of assembly. As shown in FIGS. 7 and 8, the insulation layer 160 is formed on the first antenna layer 150. The insulation layer 160 can be formed by printing on the first antenna layer 150 with insulation ink. The insulation ink can be any ink that provides insulation, flexibility, stretchability, and adhesion. For example, the insulation ink can be a urethane-based and/or a silicone-based ink. The insulation ink can be allowed to cure with a thermosetting process that may include an elevated temperature and/or pressure for a duration of time. While the insulation layer 160 can be provided over significant portions of the first antenna layer 150, the insulation layer 160 can leave exposed the first terminal end 152, the second terminal end 158, the first connector end 154, and the second connector end 156. The exposed portions allow for electrical connections to be made in later stages of assembly.

Figure 9:
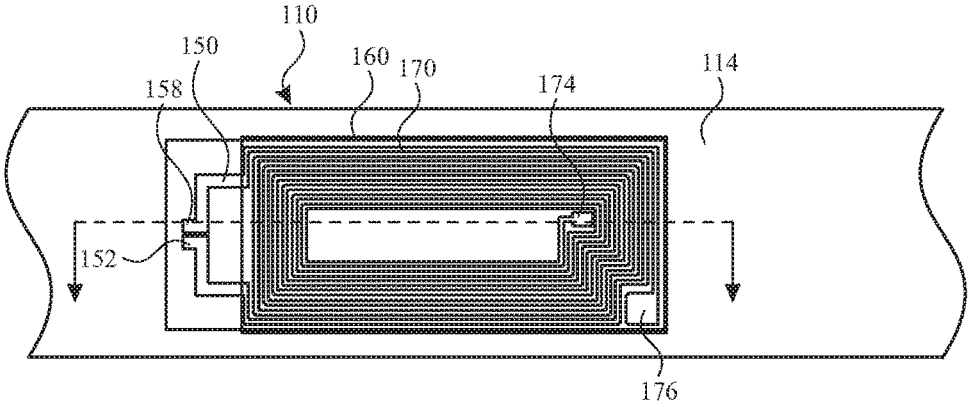
FIG. 9 illustrates a top view of the watch band in a third stage of assembly, according to some embodiments of the present.
Figure 10:
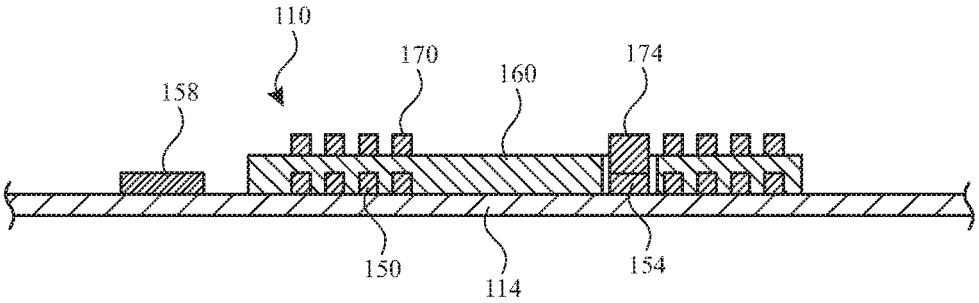
FIG. 10 illustrates a sectional view of the watch band of FIG. 9, according to some embodiments of the present.

FIGS. 9 and 10 illustrate, respectively, a top view and a sectional view of the watch band 110 in a third stage of assembly. As shown in FIGS. 9 and 10, the second antenna layer 170 is formed on the insulation layer 160 and opposite the first antenna layer 150. The second antenna layer 170 can be formed by printing on the insulation layer 160 with a conductive ink (e.g., paste). The conductive ink can be allowed to cure with a thermosetting process that may include an elevated temperature and/or pressure for a duration of time. As shown in FIG. 9, a third connector end 174 and a fourth connector end 176 can be provided to connect to the first antenna layer 150. For example, the third connector end 174 and the fourth connector end 176 of the second antenna layer 170 can electrically connect to, respectively, the first connector end 154 and the second connector end 156 of the first antenna layer 150. The electrical connections can be provided by printing directly through the openings in the insulation layer 160 to the first antenna layer 150. As such, the first antenna layer 150 is operatively connected to the second antenna layer 170 through the insulation layer 160. For example, the first antenna layer 150 and the second antenna layer 170 can form an electrically continuous pathway between the first terminal end 152 and the second terminal end 158 of the first antenna layer 150.

Figure 11:
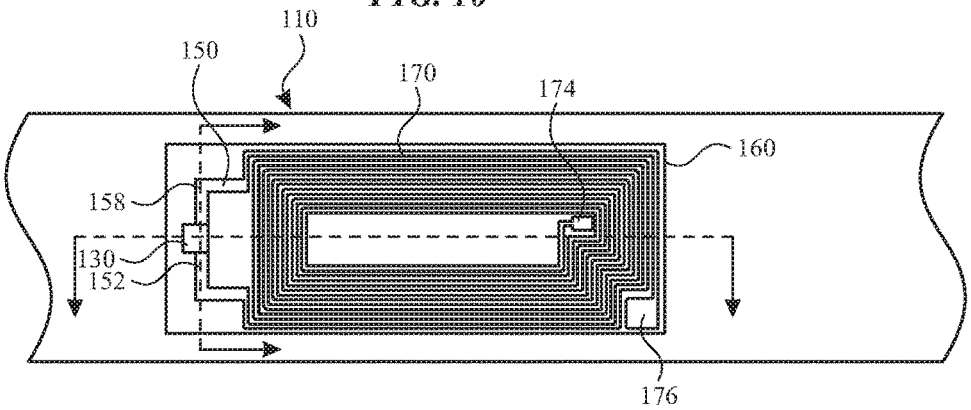
FIG. 11 illustrates a top view of the watch band in a fourth stage of assembly, according to some embodiments of the present.
Figure 12:
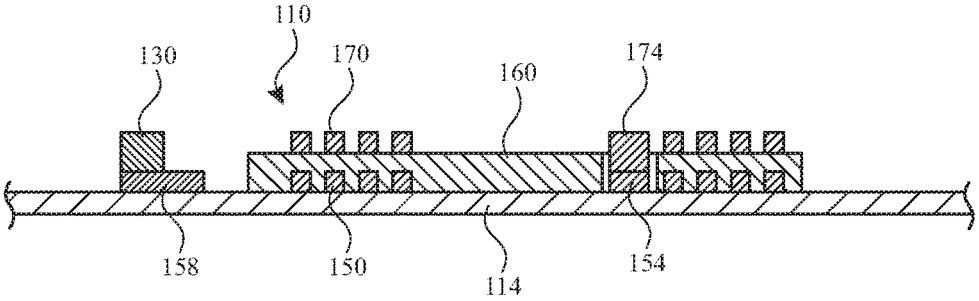
FIG. 12 illustrates a sectional view of the watch band of FIG. 11, according to some embodiments of the present.

FIGS. 11 and 12 illustrate, respectively, a top view and a sectional view of the watch band 110 in a fourth stage of assembly. As shown in FIGS. 11 and 12, a control unit 130 is connected to the first antenna layer 150. In particular, the control unit 130 can be connected to the first terminal end 152 and the second terminal end 158 of the first antenna layer 150. As such, the control unit 130 is directly connected to the first antenna layer 150 and operatively connected to the second antenna layer 170 via the first antenna layer 150. The control unit 130 can be an integrated circuit or another type of circuit that controls operation of the antenna.

Figure 13:
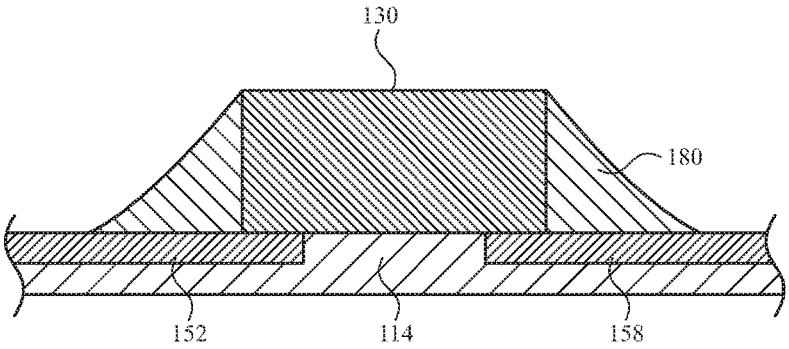
FIG. 13 illustrates another sectional view of the watch band of FIG. 11, according to some embodiments of the present.

FIG. 13 illustrates another sectional view of the watch band 110 in the fourth stage of assembly. As shown in FIG. 13, a support member 180 is formed and connected to the control unit 130 and end portions of the first antenna layer 150. The support member 180 can reinforce the connection between the first antenna layer 150 and the control unit 130, which can be susceptible to breakage during assembly and/or while worn by a user. Forming the support member 180 can include an underfill potting operation. The support member 180 can be connected to the control unit 130, the first terminal end 152, and the second terminal end 158. The support member 180 can be provided about part or an entire periphery of the control unit 130. The support member 180 can be formed by application (e.g., as an adhesive paste). The adhesive paste can be allowed to cure with a thermosetting process that may include an elevated temperature and/or pressure for a duration of time. The adhesive paste can include an epoxy resin or other curable substance. When cured, the support member 180 has a rigidity that is greater than a rigidity of the watch band body 114.

In a final stage of assembly, the first antenna layer 150, the insulation layer 160, the second antenna layer 170, and the control unit 130 can be surrounded with additional portions of the watch band body 114 (e.g., base material). The final configuration can be as illustrated in FIGS. 3 and 4. The additional portions of the watch band body 114 (e.g., base material) can be provided in a molding process (e.g., in a second shot molding) to entirely surround and encapsulate the embedded components. The reinforcement provided by the support member can protect and maintain the connection between the control unit and the terminal ends of the antenna during the additional processing (e.g., molding).

Figure 14:
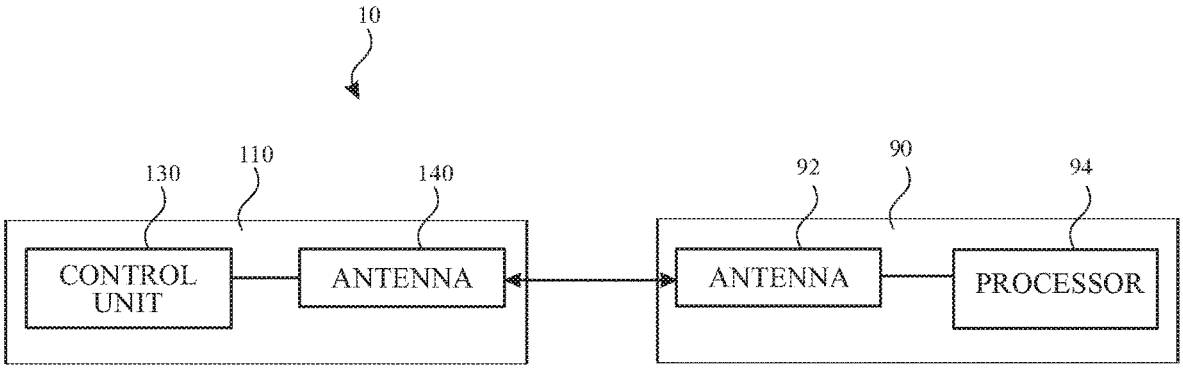
FIG. 14 illustrates a block system diagram of a watch, according to some embodiments of the present.

A watch band can provide communication with an external device. FIG. 14 illustrates a block system diagram of a watch 10, including the watch band 110. The watch band 110 can interact with an external device 90 via the antenna 140. Interactions with an external device 90 can optionally be independent of the operations of a watch body. For example, the antenna 140 and the control unit 130 of the watch band 110 can form an RFID tag that communicates with the external device 90. The external device 90 can include an antenna 92 and a processor 94 to act as a reader or interrogator for interactions with the watch band 110.

To read the information encoded on the watch band 110, transmitter-receiver of the external device 90 operates the antenna 92 to emit a signal to antenna 140. The control unit 130 responds with the stored information via the antenna 140. The information may include an identification of the watch band 110 or transmission of other information stored in the watch band 110. When the external device 90 receives the transmission from the watch band 110, the identification or other information can be used to select one or more corresponding actions to be performed by the external device 90. For example, the identification or other information can be used to provide access to privileges or functions of the external device 90.

The watch band 110 can be passive or powered. For example, the watch band 110 can use wireless energy from the external device 90 to perform its operations (e.g., to transmit its stored information back to the external device 90). Additionally or alternatively, the control unit 130 can include a power source that powers the transmission of information via the antenna 140.

Figure 15:
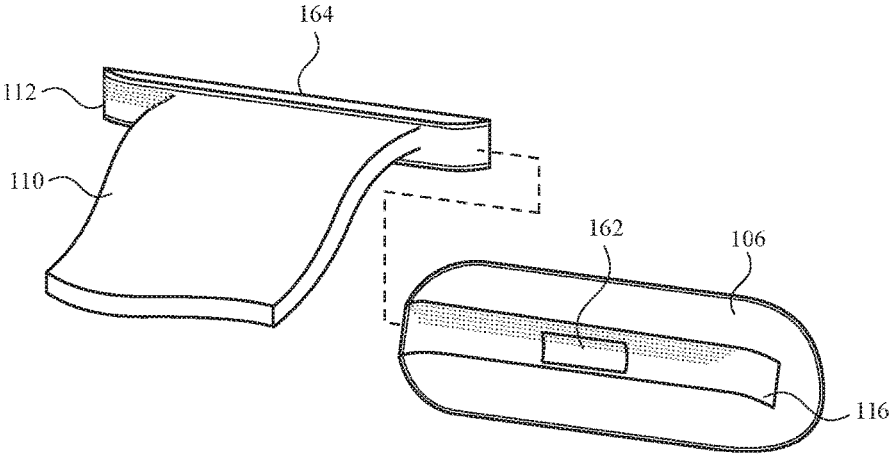
FIG. 15 illustrates a perspective view of a connection mechanism of a watch, according to some embodiments of the present disclosure.

A watch band can provide various operations based on commands from a watch body. FIG. 15 illustrates a perspective view of a connection mechanism of a watch, according to some embodiments of the present disclosure. An electrical connection can be made and maintained upon mechanical securement of the watch band 110 to the housing 106 of the watch body. The housing 106 of the watch body can include a watch body electrical connector 162, for example, within a channel 114 formed in the housing 106. The attachment member 112 of the watch band 110 can include a watch band electrical connector 164 for electrically connecting to the watch body electrical connector 162 when the attachment member 112 is connected to the housing 106, for example by insertion into the channel 116. For example, the watch body electrical connector 162 and/or the watch band electrical connector 164 can include pogo pins or other conductive surfaces for mutual contact and electrical connection.

Figure 16:
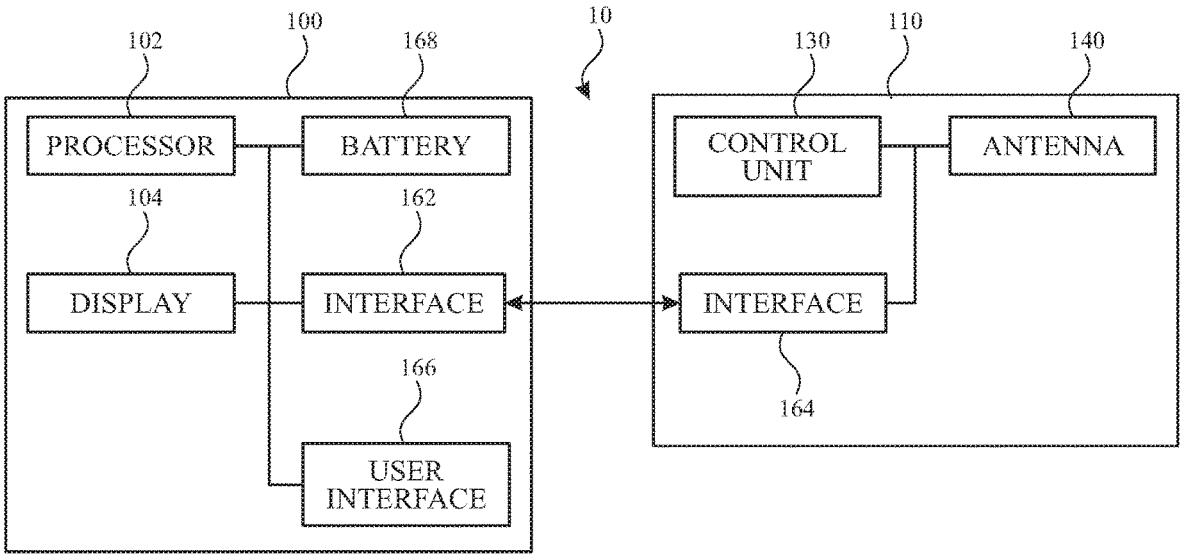
FIG. 16 illustrates a block system diagram of a watch, according to some embodiments of the present.

FIG. 16 illustrates a block system diagram of a watch 10, including the watch body 100 and the watch band 110. The watch body 100 can include components for interacting with a user, the watch band 110, and/or another device. The watch body 100 can include components that facilitate operation of the control unit 130 and/or the antenna 140.

The watch band 110 can operate in concert with the watch body 100. For example, the watch body 100 can control operation of the control unit 130 and/or the antenna 140. The watch body 100 and the watch band 110 can include appropriate circuitry and connections to perform these operations.

As shown in FIG. 16, the watch body 100 can include components for interacting with a user. For example, the display 104 may provide an image or video output for the watch body 100. The display 104 may also provide an input surface for one or more input devices such as a touch sensing device, force sensing device, temperature sensing device, and/or a fingerprint sensor. The display 104 may be any size suitable for inclusion at least partially within the housing of the watch body 100 and may be positioned substantially anywhere on the watch body 100. The watch body 100 can further include one or more other user interfaces 166, for receiving input from and/or providing output to a user. For example, one or more buttons, dials, crowns, switches, or other devices can be provided for receiving input from a user. The user interface 166 can include a speaker, a microphone, and/or a haptic device. A haptic device can be implemented as any suitable device configured to provide force feedback, vibratory feedback, tactile sensations, and the like. For example, in one embodiment, the haptic device may be implemented as a linear actuator configured to provide a punctuated haptic feedback, such as a tap or a knock.

As further shown in FIG. 16, the watch body 100 includes one or more processors 102 that include or are configured to access a memory having instructions stored thereon. The instructions or computer programs may be configured to perform one or more of the operations or functions described with respect to the watch 10. The processors 102 can be implemented as any electronic device capable of processing, receiving, or transmitting data or instructions. For example, the processors 102 may include one or more of: a microprocessor, a central processing unit (CPU), an application-specific integrated circuit (ASIC), a digital signal processor (DSP), or combinations of such devices. As described herein, the term "processor" is meant to encompass a single processor or processing unit, multiple processors, multiple processors, or other suitably configured computing element or elements. The memory can store electronic data that can be used by the watch body 100. For example, a memory can store electrical data or content such as, for example, audio and video files, documents and applications, device settings and user preferences, timing and control signals or data for the various modules, data structures or databases, and so on. The memory can be configured as any type of memory. By way of example only, the memory can be implemented as random access memory, read-only memory, Flash memory, removable memory, or other types of storage elements, or combinations of such devices.

As further shown in FIG. 16, the watch body 100 may include a battery 168 that is used to store and provide power to the other components of the watch body 100. The battery 168 may be a rechargeable power supply that is configured to provide power to the watch body 100 and/or the watch band 110 while being worn by the user. The watch body 100 may also be configured to recharge the battery 168 using a wireless charging system.

As further shown in FIG. 16, the watch body 100 may optionally include a watch body interface 162 that facilitates transmission of data and/or power to or from other electronic devices across standardized or proprietary protocols. For example, a watch body interface 162 can transmit electronic signals via a wireless and/or wired network connection. Examples of wireless and wired network connections include, but are not limited to, Wi-Fi, Bluetooth, infrared, RFID and Ethernet. The watch body interface 162 can communicate with or sense the watch band 110 via a watch band interface 164 of the watch band 110 when the watch band 110 is connected to the watch body 100 (e.g., with a lug of the watch band 110 inserted within a channel of the watch body 100 so the watch body interface 162 is in electrical contact with the watch band interface 164). The watch body 100 can provide power to the watch band 110 via the watch body interface 162 and the watch band interface 164.

The control unit 130 can operate in concert with the antenna 140 to communicate with another device. The control unit 130 can perform operations based on commands generated by the processor 102 of the watch body 100 and communicated via the watch body interface 162 and the watch band interface 164. The wireless operations of the antenna 140 can be via a wireless connection. Examples of wireless connections include, but are not limited to, cellular, Wi-Fi, Wi-Fi Direct, Bluetooth, short-range 802.11, near field communication (NFC), RFID, high frequency focused beams, WirelessHD, WiGig, and Wi-Fi IEEE 802.11ad. Accordingly, the watch body 100 can utilize the antenna 140 of the watch band 110 for communications with another device. Such connections can be used for phone calls, data transmission, messaging, and other types of communications facilitated by the watch body 100.

Figure 17:
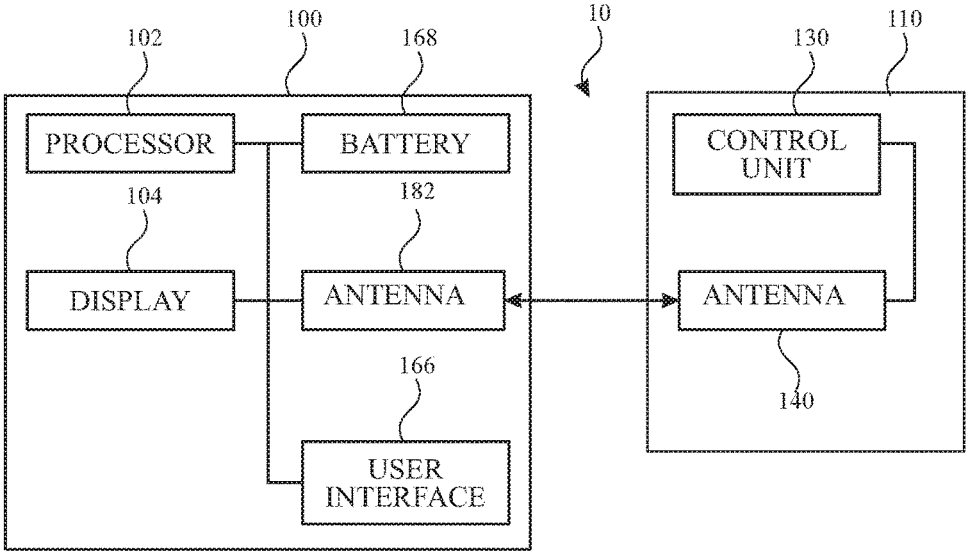
FIG. 17 illustrates a block system diagram of a watch, according to some embodiments of the present.

A watch band can use its antenna to communicate with a watch body. As shown in FIG. 17, the watch body 100 can include an antenna 182 for communicating with the antenna 140 of the watch band 110. The watch body 100 can further include a processor 102, a display 104, a user interface 166, and/or a battery 168 to facilitate operation of the watch body 100. The antenna 182 of the watch body 100 can be wirelessly connected to the antenna of the watch band 110 to communicate information from the watch band 110.

To read the information encoded in the watch band 110, a transmitter-receiver of the watch body 100 operates the antenna 182 to emit a signal to antenna 140. The control unit 130 responds with the stored information via the antenna 140. The information may include an identification of the watch band 110 or transmission of other information stored in the watch band 110. When the watch body 100 receives the transmission from the watch band 110, the identification or other information can be used to select one or more corresponding actions to be performed by the watch body 100. For example, the identification or other information can be used to provide access to privileges or functions of the watch body 100. Different functions can be performed by the watch body 100 based on the type of watch band 110 that is identified as being provided to the watch body 100 to form the watch 10.

Actions performed by the watch body 100 in response to detection of a watch band 110 include influencing regular operation of the watch body 100. For example, the regular operation of the watch body 100 can be maintained with additional or altered features based on the selected watch band 110. As such, the user's experience with the watch body 100 during its regular operation is enhanced.

In some embodiments, upon identifying a particular watch band 110, the watch body 100 provides a feature of a visual user interface that corresponds to a characteristic of the watch band 110. For example, the watch body 100 can display on the display 104 a feature that is substantially the same color as the watch band 110. Alternatively or additionally, the feature can be a similar color, a matching color, or a complementary color. Exemplary features include watch hands, text, numbers, symbols, graphics, charts, markers, or any displayed item. By further example, displayed information, watch faces, menu items, and selectable icons can be selected based on the selection of watch band 110.

In some embodiments, upon identifying a particular watch band 110, other settings of the watch body 100 can be modified. A watch band 110 can be associated with an activity that is supported by the watch body 100. For example, an exercise band can be worn when a user is exercising. Upon identification of the exercise band, actions conducive to an exercise session can be performed by the watch body 100. For example, the watch body 100 can display particular information, track activity of the user, take a biometric reading, record a location of the user, launch an activity tracking app, and/or modify notifications settings (e.g., to be more prominent). For example, the watch body 100 can display particular information, modify notifications settings (e.g., to be less prominent), provide reminders to the user, and/or record a location of the user.

The watch body 100 can perform a variety of other actions upon identification of a watch band 110. It will be recognized that the detection of a watch band 110 can be followed by any associated action that can be performed by the watch body 100. For example, where the watch body 100 has the required capabilities, the watch body 100 launches an app, opens a website, starts a timer, displays a message, provides an alert, communicates with another device, and/or other functions.

It will be recognized that one, some, or all of the components of the watch body 100 of FIGS. 14-17 can be provided, alternatively or additionally, on and/or within the watch band 110 of the watch 10. For example, a processor 102, a display 104, a battery 168, a watch body interface 162, and/or a user interface 166 can be provide on the watch body 100 and/or the watch band 110. It will be further recognized that one, some, or all of the components of the watch band 110 of FIGS. 14-17 can be provided, alternatively or additionally, on and/or within the watch body 100 of the watch 10. For example, a control unit 130, an antenna 140, and/or a watch band interface 164 can be provide on the watch band 110 and/or the watch body 100.

Accordingly, the watch bands described herein provide an antenna that can be operated for wireless communication with other devices. The antenna can be embedded within a body of the watch band to protect the antenna from an external environment and to conceal it from view. The antennas can adaptably stretch, bend, and flex with the watch bands body, thereby avoiding damage from applied forces while also maintaining the compliance and comfort of the watch band while worn by a user.

To illustrate the interchangeability of hardware and software, items such as the various illustrative blocks, modules, components, methods, operations, instructions, and algorithms have been described generally in terms of their functionality. Whether such functionality is implemented as hardware, software or a combination of hardware and software depends upon the particular application and design constraints imposed on the overall system. Skilled artisans may implement the described functionality in varying ways for each particular application.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A watch band for securing a watch to a wrist of a user, the watch band comprising:

a lug configured to be releasably attached to a housing of the watch;

a watch band body extending from the lug and having embedded therein an antenna and a control unit, the control unit being positioned between the lug and the antenna;

the antenna operatively connected to the control unit and comprising:

a first antenna layer;

a second antenna layer, wherein the first antenna layer and the second antenna layer are of a material comprising an elastic polymer and conductive particles; and an insulation layer between portions of the first antenna layer and the second antenna layer.

2. The watch band of claim 1, wherein the first antenna layer and the second antenna layer form a continuous loop from a first terminal end connected to the control unit to a second terminal end connected to the control unit.

3. The watch band of claim 1, further comprising a support member connected to the control unit and terminal ends of the first antenna layer, wherein the support member is more rigid than the watch band body.

4. The watch band of claim 3, wherein the support member comprises an epoxy resin.

5. The watch band of claim 1, wherein the watch band body comprises fluoroelastomeric polymer.

6. The watch band of claim 1, wherein the first antenna layer forms multiple first windings about an axis, and the second antenna layer forms multiple second windings about the axis.

7. The watch band of claim 1, wherein the control unit is operatively connected to the second antenna layer via the first antenna layer.

8. The watch band of claim 1, further comprising a watch band interface for operatively connecting the control unit to a processor within a watch body of the watch.

9. A watch comprising:

the watch band of claim 1 further comprising:

a watch band interface; and a watch body comprising:

a display;

a channel;

a processor; and a watch body interface, wherein the processor is configured to be operatively connected to the control unit via the watch body interface and the watch band interface when the lug is inserted into the channel.

10. A watch band for securing a watch to a wrist of a user, the watch band comprising:

a watch band body configured to be stretched along a longitudinal length of the watch band body;

a lug at an end of the watch band body, the lug being configured to releasably attach the watch band body to a housing of the watch;

an antenna encapsulated within the watch band body and being directly connected to an inner surface of the watch band body, wherein the antenna comprises a mixture of a stretchable polymer and conductive particles such that the antenna is stretchable along the longitudinal length with stretching of the watch band body; and a control unit between the antenna and the lug.

11. The watch band of claim 10, wherein:

the antenna comprises:

a first antenna layer; and a second antenna layer; and the watch band further comprises an insulation layer between portions of the first antenna layer and the second antenna layer, wherein the insulation layer is stretchable along the longitudinal length with stretching of the watch band body.

12. A watch band for securing a watch to a wrist of a user, the watch band comprising:

a watch band body having embedded therein an antenna and a control unit;

the antenna operatively connected to the control unit and comprising:

a first antenna layer comprising multiple first windings about an axis, an innermost one of the first windings terminating in a first connector end and an outermost one of the first windings terminating in a second connector end;

a second antenna layer, comprising multiple second windings about the axis, an innermost one of the second windings terminating in a third connector end and an outermost one of the second windings terminating in a fourth connector end; and an insulation layer between and in contact with portions of the first antenna layer and the second antenna layer, wherein the first connector end is electrically connected to the third connector end through the insulation layer, and the second connector end is electrically connected to the fourth connector end through the insulation layer.

13. The watch band of claim 12, further comprising a lug configured to releasably attach to a housing of a watch body, wherein the control unit is positioned between the antenna and the lug.

14. The watch band of claim 12, further comprising a support member connected to the control unit and terminal ends of the first antenna layer, wherein the support member is more rigid than the watch band body.

15. The watch band of claim 14, wherein the support member comprises an epoxy resin.

16. The watch band of claim 12, wherein the watch band body comprises fluoroelastomeric polymer.

17. The watch band of claim 12, wherein the control unit is operatively connected to the second antenna layer via the first antenna layer.

18. The watch band of claim 12, further comprising a watch band interface for operatively connecting the control unit to a processor within a watch body of the watch.

* * * * *